US008061348B1

(12) United States Patent
Rodriguez

(10) Patent No.: US 8,061,348 B1
(45) Date of Patent: Nov. 22, 2011

(54) FIREPLACE OVEN

(76) Inventor: Martin Rodriguez, Colton, CA (US)

( * ) Notice: Subject to any disclaimer, the term of this patent is extended or adjusted under 35 U.S.C. 154(b) by 409 days.

(21) Appl. No.: 12/141,804

(22) Filed: Jun. 18, 2008

Related U.S. Application Data

(60) Provisional application No. 60/944,705, filed on Jun. 18, 2007.

(51) Int. Cl.
*F24B 1/182* (2006.01)

(52) U.S. Cl. ..... 126/506; 126/1 B; 126/1 D; 126/1 E; 126/19 R; 126/25 R; 126/273.5; 126/274; 126/50; 126/55

(58) Field of Classification Search ..... 126/19 R, 126/25 R, 273.5, 274, 50, 506
See application file for complete search history.

(56) References Cited

U.S. PATENT DOCUMENTS

| | | | | | |
|---|---|---|---|---|---|
| 1,852,526 | A | * | 4/1932 | Kemp | 432/31 |
| 2,088,444 | A | * | 7/1937 | Schneider | 126/44 |
| 2,133,184 | A | * | 10/1938 | Burrow | 126/1 R |
| 2,141,808 | A | * | 12/1938 | Brodbeck | 126/36 |
| 2,224,316 | A | * | 12/1940 | Rolfes | 126/1 F |
| 2,246,440 | A | * | 6/1941 | Hester | 126/8 |
| 2,295,889 | A | * | 9/1942 | Bufton | 126/44 |
| 2,300,486 | A | * | 11/1942 | Cargile | 126/10 |
| 2,314,249 | A | * | 3/1943 | Sherman | 126/5 |
| 2,372,086 | A | * | 3/1945 | Kahn | 126/5 |
| 3,148,674 | A | * | 9/1964 | Boardman et al. | 126/19 R |
| 3,587,557 | A | * | 6/1971 | Henderson et al. | 126/21 A |
| 3,789,824 | A | * | 2/1974 | Mason | 126/59.5 |
| 4,170,219 | A | * | 10/1979 | Hansen et al. | 126/517 |
| 4,177,793 | A | * | 12/1979 | Johnson | 126/521 |
| 4,182,302 | A | * | 1/1980 | Bruce et al. | 126/4 |
| 4,182,305 | A | * | 1/1980 | Johnson | 126/515 |
| 4,224,921 | A | * | 9/1980 | Petrescue | 126/518 |
| 4,287,871 | A | * | 9/1981 | Schumann et al. | 126/518 |
| 4,304,215 | A | * | 12/1981 | Jarman | 126/515 |
| 4,338,913 | A | * | 7/1982 | Good | 126/77 |
| 4,368,721 | A | * | 1/1983 | Kroupa | 126/4 |
| 4,375,802 | A | * | 3/1983 | Wallasvaara | 126/21 A |
| 4,584,177 | A | * | 4/1986 | Fernbach et al. | 422/115 |
| 4,624,238 | A | * | 11/1986 | Hait | 126/9 R |
| 4,944,284 | A | * | 7/1990 | O'Quin | 126/41 R |
| 5,347,977 | A | * | 9/1994 | Lehikoinen et al. | 126/19 R |
| 2010/0000509 | A1 | * | 1/2010 | Babington | 126/19 R |

FOREIGN PATENT DOCUMENTS

FR 2562213 A1 * 10/1985

* cited by examiner

*Primary Examiner* — Kenneth Rinehart
*Assistant Examiner* — Jorge Pereiro
(74) *Attorney, Agent, or Firm* — Knobbe, Martens, Olson & Bear, LLP

(57) ABSTRACT

A portable outdoor cooking and decorative appliance including a combustion compartment and a separate oven compartment. The appliance can burn a variety of solid, liquid, and/or gaseous fuels. Material combustion products are inhibited from contacting food items inside the oven compartment to avoid contamination and transfer of undesired tastes, smells, and materials. The appliance is constructed to more efficiently transfer heat to the oven compartment to improve cooking speed and capability and reduce fuel needed. The appliance can include transparent doors such that users can view the interior of the appliance during use, without opening the doors.

10 Claims, 6 Drawing Sheets

FIREPLACE OVEN

CROSS-REFERENCE TO RELATED APPLICATIONS

This application claims the priority benefits of U.S. Provisional Application 60/944,705 filed Jun. 18, 2007 which is incorporated herein in its entirety by reference.

BACKGROUND OF THE INVENTION

1. Field of the Invention

The invention relates to the field of cooking and outdoor appliances and to a combined oven and fireplace.

2. Description of the Related Art

A variety of outdoor fireplaces are known and widely used to provide a pleasing aesthetic contribution in outdoor or open environments. For example, an outdoor fireplace can provide a campfire ambience in an outdoor residential setting. Outdoor fireplaces generally include some configuration of open container to hold the fuel material and contain ashes. Outdoor fireplaces also generally elevate the fire from the ground, in contrast to fires that can be built directly on the ground.

A variety of outdoor cooking appliances, commonly known as barbecues or hibachis, are widely used for outdoor cooking. Such cooking appliances can be adapted to use solid fuel, such as fuel wood and/or charcoal or fuel gases such as natural gas or propane to generate heat for the cooking. Such cooking appliances generally include an open container where the fuel combustion takes place. Such open containers can have a variety of shapes, including generally hemispherical, semicylindrical, rectangular, pyramidal, or other shapes. Outdoor cooking appliances are also generally provided with one or more grills supported and arranged generally above the combustion region to support food items for cooking above the combustion region.

An open configuration of outdoor cooking appliance suffers the limitation that a significant portion of the heat generated can be lost due to radiant and convective heat escaping through the open upper region of the cooking appliance. This results in a significant decrease in cooking efficiency, generally resulting in higher fuel consumption and extended cooking times and limitations in the type of cooking methods that can be used with the appliance. Accordingly, outdoor cooking appliances are frequently provided with a movable cover to allow access to the grill area for placement and removal of food items but also allowing the cooking appliance to be at least partially closed to assist in retaining heat within the cooking appliance to improve cooking efficiency. Such closable cooking appliances will generally include one or more vents to facilitate provision of fresh air to support combustion and/or allow combustion products to escape the interior of the cooking appliance.

However, such cooking appliances suffer the drawback that placing the cooking region over the combustion region contributes to exposure of the food items being cooked to combustion products such as smoke, soot, and possible remnants from previously cooked food items. While the heat of combustion is a combustion product that is desirably communicated to the food items, frequently smoke, soot, and remnants of previously cooked food items can contributed undesired tastes and aroma to subsequently cooked food items. Combustion of solid fuels can also result in ash and cinders accumulating on the surface of the food. In addition, certain foods can drip combustible materials such as fat and oils that can burn upon contact with the normal fuel and result in excessive heat and burning of the food.

Enclosing a cooking appliance detracts from the aesthetic qualities of the cooking appliance as the frequently desirable appearance of the combustion is obscured from view. Thus, it will be understood that there exists a need for an improved design of outdoor cooking appliance which inhibits exposure of cooked items to undesired combustion products and maintains the desired aesthetic qualities of open outdoor fireplaces.

SUMMARY OF THE INVENTION

One embodiment comprises a combustion appliance including an inwardly arranged structure defining a combustion compartment and a separate oven compartment, an outwardly arranged structure substantially encompassing the inwardly arranged structure, an intermediate structure interposed between the inwardly and outwardly arranged structures, an outward space interposed between the outwardly arranged structure and the intermediate structure and providing thermal insulation between the outwardly arranged structure and the inwardly arranged and intermediate structures, an exhaust space arranged between the inwardly arranged structure and the intermediate structure and in fluid communication with the combustion compartment such that physical combustion components can vent from the combustion compartment through the exhaust space around at least a portion of the oven compartment and out from the appliance and such that the physical combustion components are materially separated from an interior of the oven compartment, and a movable oven door such that actuation of the oven door can enclose or provide access to the interior of the oven compartment.

Another embodiment includes a portable combustion apparatus comprising at least one combustion compartment, at least one enclosable oven compartment arranged adjacent the at least one combustion compartment such that, in a closed configuration, material combustion products resulting from combustion occurring in the at least one combustion compartment are routed around an exterior of the at least one enclosable oven compartment and physically isolated from an interior of the at least one enclosable oven compartment and such that heat from the combustion is preferentially transferred to the interior of the at least one enclosable oven compartment.

A further embodiment includes a combustion appliance comprising an inwardly arranged structure defining a combustion compartment and an oven compartment, an outwardly arranged structure substantially encompassing the inwardly arranged structure, an exhaust space arranged between the inwardly and the outwardly arranged structures and in fluid communication with the combustion compartment such that physical combustion components can vent from the combustion compartment through the exhaust space and out from the appliance and such that the physical combustion components are materially separated from an interior of the oven compartment, and a movable oven door such that actuation of the oven door can enclose or provide access to the interior of the oven compartment.

DETAILED DESCRIPTION OF THE PREFERRED EMBODIMENT

Figure 1:
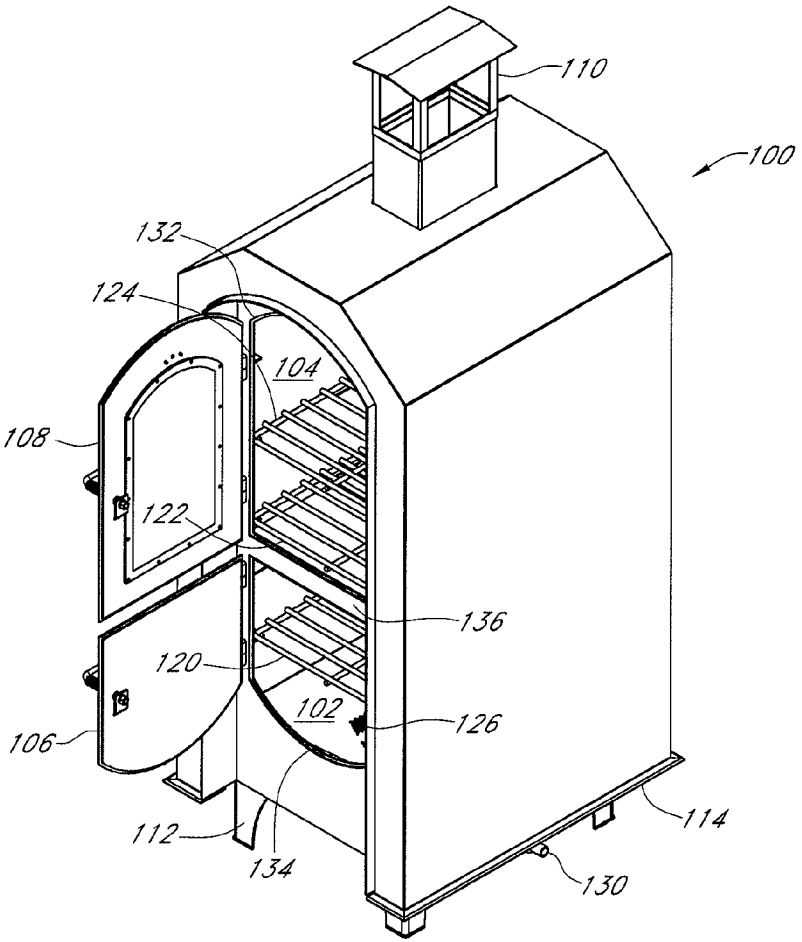
FIG. 1 is a front perspective view of one embodiment of a fireplace oven in an open configuration.
Figure 4:
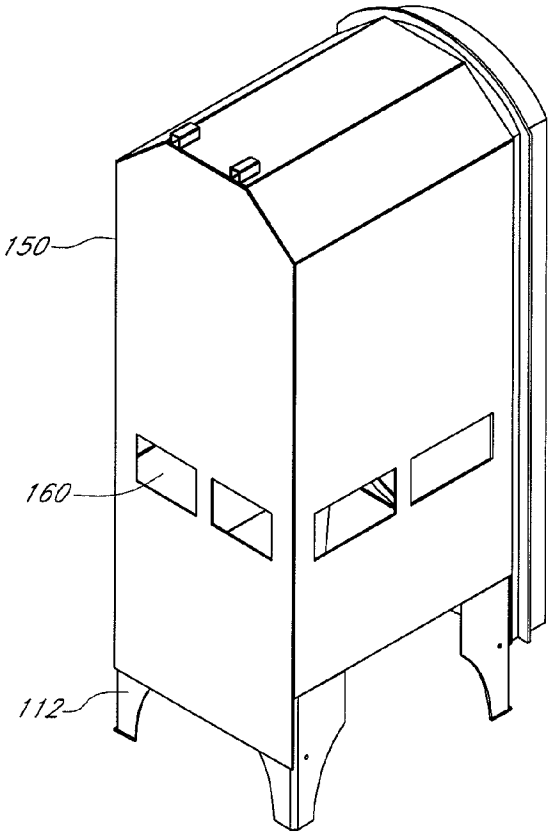
FIG. 4 is a rear perspective view of one embodiment of an inner structure of a fireplace oven.
Figure 3:
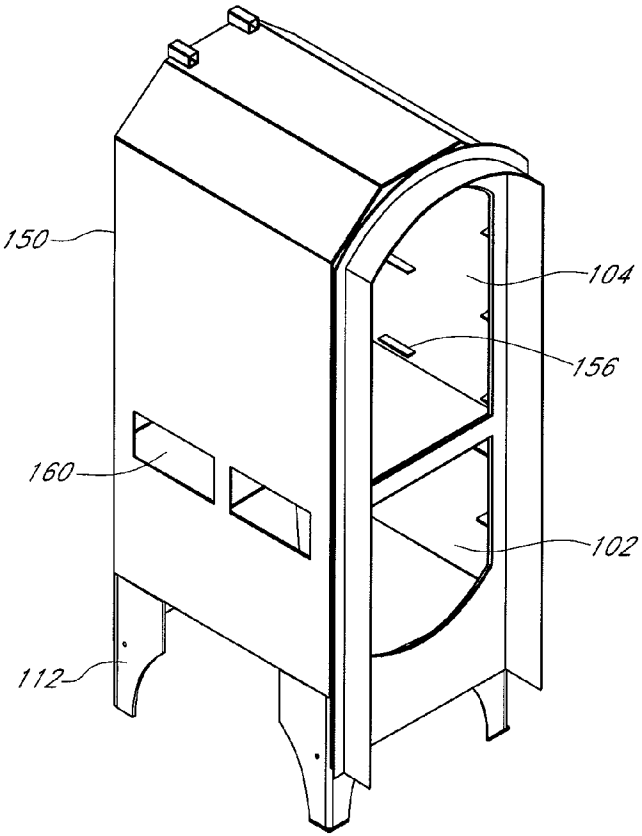
FIG. 3 is a front perspective view of one embodiment of an inner structure of a fireplace oven.
Figure 6:
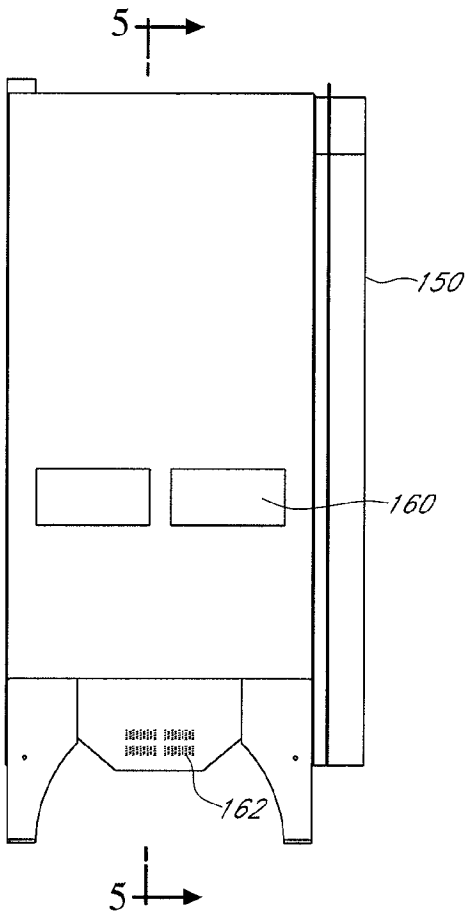
FIG. 6 is a side view of one embodiment of an inner structure of a fireplace oven.
Figure 5:
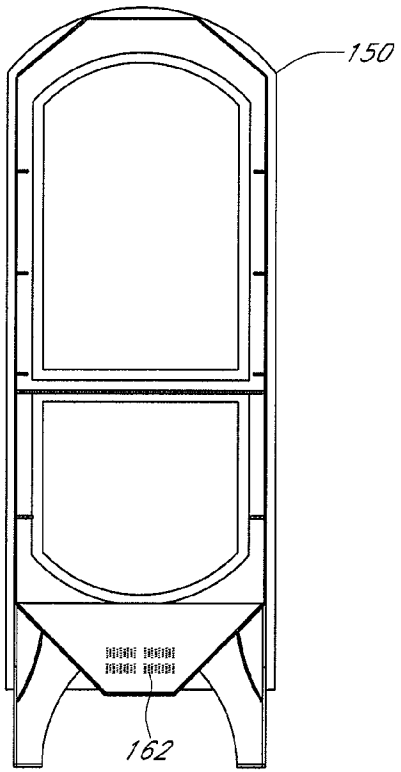
FIG. 5 is a front view of one embodiment of an inner structure of a fireplace oven.

Reference will now be made to the Figures wherein like parts and structures have the same reference designation throughout. FIG. 1 illustrates one embodiment of a fireplace oven 100. The fireplace oven 100 is designed to offer users an outdoor cooking appliance that offers the aesthetic appeal of an outdoor fireplace. The fireplace oven 100 is further designed and constructed to offer improved cooking capabilities to offer a greater variety of cooking methods in an outdoor setting beyond those available with traditional barbecues, hibachis, or other grill-type outdoor cooking appliances.

FIG. 1 illustrates the fireplace oven 100 in an "open" configuration or in a configuration where access can be gained to the interior of the fireplace oven 100. In this embodiment, the fireplace oven 100 comprises a combustion compartment 102 and an oven compartment 104. The combustion compartment 102 is configured as an enclosable space within which combustion can occur. The fireplace oven 100 in various embodiments can be constructed to utilize solid fuel such as firewood, charcoal, coal, wood pellets, artificial fire logs, and the like to fuel combustion. In some embodiments, the fireplace oven 100 can be constructed and designed to utilize liquid fuels such as kerosene, fuel oil, diesel fuel, biodiesel, white gasoline, ethanol, methanol, or other combustible liquids. In some embodiments, the fireplace oven can be constructed to utilize gaseous fuels such as natural gas, propane, butane, hydrogen, or other flammable gases to support combustion within the combustion chamber 102.

The oven compartment 104 is configured to provide an enclosable cooking region within which a variety of cooking methods can be utilized to cook a variety of foods. For example, various embodiments of the fireplace oven 100 can support dry roasting, baking, steaming, rotisserie, and other types of cooking methods to cook foods including but not limited to breads, pastries, meats, vegetables, seafood, and others.

Figure 2:
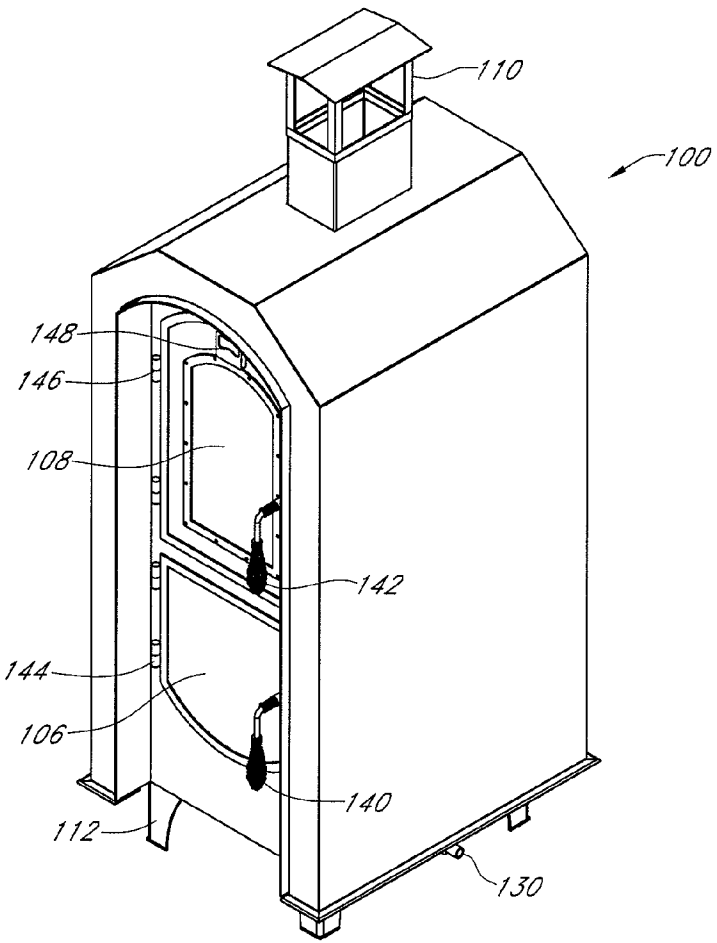
FIG. 2 is a front perspective view of one embodiment of a fireplace oven in a closed configuration.

In one embodiment, a fireplace oven 100 comprises a combustion door 106 and an oven door 108. The combustion door 106 and oven door 108 are moveably engaged with remaining components of the fireplace oven 100 so as to be moveable from an "open" configuration as illustrated in FIG. 1 and a "closed" configuration as illustrated in FIG. 2.

The open configuration illustrated in FIG. 1 facilitates placement and retrieval of food items in the oven compartment 104 and similarly placement, ignition and/or cleaning of fuels within the combustion compartment 102. The closed configuration of the oven compartment 104 facilitates more efficient cooking by retaining heat generated by the fireplace oven 100 within the oven compartment 104. The closed configuration of the combustion compartment 102, for example as provided by closing the combustion door 106, can facilitate more efficient combustion of fuels within the combustion compartment 102, for example by regulating air flow into the combustion compartment 102. Further, the closed configuration of the combustion compartment 102 provides improved safety by providing a physical barrier between users and passers-by and the interior of the combustion compartment 102 and possibly hot items located therein.

In some embodiments, the combustion door 106 is comprised at least partially of high temperature resistant and optically transparent materials, such as tempered glass. In these embodiments, the transparent aspects of at least portions of the combustion door 106 provide the aesthetic advantage that persons can at least partially view the interior of the combustion compartment 102 and view combustion occurring therein. It will be understood that many people find the visual appearance of a contained fireplace or campfire to be appealing and embodiments of the fireplace oven 100 including transparent aspects of the combustion door allow these pleasing aspects to be enjoyed by users of the fireplace oven 100.

Embodiments including an at least partially transparent combustion door 106 also offer the advantage of easier monitoring of the combustion conditions within the combustion compartment 102. For example, through simple visual examination through the transparent combustion door 106, a user can ascertain whether additional fuels are needed, whether combustion is occurring as desired, whether cooking accoutrements such as wood chips for smoking should be added, and the like.

In some embodiments, the oven door 108 is comprised at least partially of transparent materials that are resistant to heat, such as tempered glass. Embodiments including at least a partially transparent aspect of the oven door 108 provide the advantage to the user of being able to visually monitor the progress of cooking occurring within the oven compartment 104. For example, where the oven door 108 is at least partially transparent, a user may visually examine food items within the oven compartment 104, for example for proper browning of baked goods, monitoring of a thermometer placed within the oven compartment 104, and a variety of other known methods and processes for visually monitoring a cooking process.

The fireplace oven 100 also comprises one or more chimneys 110. The chimney 110 is configured to facilitate withdrawal and venting of combustion components from the combustion process occurring within the combustion compartment 102. The fireplace oven 100 is further constructed such that physical combustion components resulting from combustion occurring within the combustion compartment 102 such as smoke, soot, carbon dioxide, unburned hydrocarbons, water vapor, carbon monoxide, and the like are directed around the oven compartment 104 and withdrawn and vented out the chimney 110 such that contact between the physical combustion components and the interior of the oven compartment 104 is reduced. The fireplace oven 100 is further constructed such that the heat resulting from combustion occurring with the combustion compartment 102 including radiant heat resulting from the combustion and convective heat entrained with the physical combustion components is preferentially conveyed to the oven compartment 104 to provide more efficient heating of the oven compartment 104. Additional details and description of these aspects of the fireplace oven 100 will be provided below following a more detailed description of the design and construction of other components of the fireplace oven 100.

In some embodiments, a fireplace oven 100 is portable and further comprises a plurality of supports or legs 112. The legs 112 provide structural support such that the fireplace oven 100 can be placed on a surface for use. The legs 112 further provide the functionality of elevating a lower surface 114 of the fireplace oven 100 above a supporting surface. As will be understood, in use the fireplace oven 100 can generate at least certain regions of relatively high temperatures. The elevation provided by the legs 112 distances such components having elevated temperature from adjacent surfaces and materials. This aspect of the fireplace oven 100 provides increased flexibility for placement of the fireplace oven 100 by allowing use in areas where the high temperatures generated during use of the fireplace oven 100 might otherwise cause damage and/or present a fire risk.

In some embodiments, a fireplace oven 100 comprises one or more combustion racks 120. The combustion rack(s) 120 is arranged and supported within the combustion compartment 102 generally above a region where combustion would occur. The combustion rack 120 provides the utility of providing a support surface for food items where a user wishes to utilize conventional grilling type cooking techniques where food material is placed directly over a combustion region. Thus, the combustion rack 120 supports traditional type barbecuing or grilling type cooking techniques. The combustion rack 120 also supports smoking type cooking techniques that can be dry or wet smoking by placing food items on the one or more combustion racks 120 and placing appropriate smoking components, such as wood chips, near a heat source.

In some embodiments, a fireplace oven 100 comprises one or more oven racks, such as a first oven rack 122 and a second oven rack 124. The oven racks 122, 124 provide the utility of providing a support surface for various food items to be cooked within the oven compartment 104. The oven racks 122, 124 are arranged and supported within the oven compartment 104. It will be understood that one or more or all of the racks 120, 122, 124 can be moveable or adjustable for placement in different locations within the respective compartments 102, 104. For example, the racks 122, 124 can be moveable to accommodate different sized items to be cooked, and/or for placement at various elevations within the oven compartment 104 to facilitate cooking at different temperatures that may occur at different locations within the oven compartment 104.

In some embodiments, a fireplace oven 100 can comprise one or more combustion assemblies 126. The combustion assembly 126 can comprise a single or an array of vents or nozzles for expelling gaseous and/or liquid fuels to support combustion within the combustion compartment 102. In certain embodiments, the combustion assembly 126 can comprise a pan or rack to support and contain solid fuels, such as firewood, wood pellets, charcoal, and the like. In some embodiments, the combustion assembly 126 can comprise a plurality of components, for example an array of vents or nozzles to support gaseous and/or liquid fuels and a tray or pan to contain wood chips for smoking type cooking.

In some embodiments, a fireplace oven 100 can comprise one or more fuel connectors 130. As previously noted, some embodiments of the fireplace oven 100 are constructed to utilize gaseous and/or liquid fuels. The fuel connection 130 provides a location and structure for connection of a fuel feed to provide the gaseous and/or liquid fuels to the fireplace oven 100. It will be understood that the fuel connection 130 can be configured as a detachable/replaceable connection and/or as a permanent or semi-permanent connection, depending on the needs of a particular application.

In some embodiments, a fireplace oven 100 comprises one or both of an oven seal 132 and a combustion seal 134. The seals 132, 134, where provided, offer improved sealing and optionally thermal insulation between an opening to the combustion compartment 102 and/or oven compartment 104 and the respective combustion door 106 and oven door 108. Where present, the seals 132, 134 can be formed and applied with well known high temperature resistant materials.

The fireplace oven 100 further comprises a combustion/oven partition 136. The combustion/oven partition 136 is arranged between or interposed between the combustion compartment 102 and oven compartment 104 so as to physically separate or isolate these regions of the fireplace oven 100 from each other. As previously noted, a desirable aspect of the fireplace oven 100 is the material separation of the oven compartment 104 from the combustion compartment 102 such that material combustion components resulting from combustion occurring within the combustion compartment 102 are materially separated or isolated from the interior of the oven compartment 104.

However, it is desirable in at least certain applications to efficiently convey heat resulting from combustion occurring within the combustion compartment 102 to the interior of the oven compartment 104. Thus, in at least some embodiments, the combustion/oven partition 136 provides material separation between the compartments 102, 104, however supports conduction and radiation of heat from the combustion compartment 102 to the oven compartment 104. For example, in some embodiments, the combustion/oven partition 136 comprises a material having a relatively high heat transfer coefficient, such as metal.

The fireplace oven 100 also comprises a combustion latch 140 and an oven latch 142. The latches 140, 142 are configured to provide a latching function to secure the respective doors 106, 108 in a closed position and also to provide a handle and actuating mechanism to unlatch the doors 106, 108 and move the doors to the open configuration, for example as illustrated in FIG. 1. As in at least certain embodiments, one or both of the doors 106, 108 can attain relatively high temperatures during use, the latches 140, 142 can preferably be provided with a insulative aspect such that a user does not injure themselves when actuating the latches 140, 142.

As previously noted, the doors 106, 108 are constructed to be moveable between an open and a closed configuration. In at least some embodiments, a fireplace oven 100 comprises a combustion hinge 144 and a oven hinge 146 to provide a pivoting type movement capability of the doors 106, 108.

In some embodiments, a fireplace oven 100 comprises one or more temperature gauges 148. The temperature gauges 148 provide a measurement reading of temperatures monitored by the temperature gauge 148. Temperature gauges can be arranged for example in one or both of the combustion compartment 102 and the oven compartment 104.

FIGS. 3, 4, 5, and 6 illustrate embodiments of an inner structure 150 of a fireplace oven 100 in a front perspective, rear perspective, front view, and side view, respectively. The inner structure 150 provides physical structure and defines interior surfaces of the combustion compartment 102 and oven compartment 104. As the inner structure 150 will be exposed during use to relatively high temperatures during the combustion and cooking processes, the inner structure 150 is preferably formed of a relatively strong material resistant to elevated temperatures. Suitable materials for the inner structure can include but are not limited to cast iron and sheet metals. In some embodiments, sheet steel of approximately 8 gauge to 18 gauge in thickness can be utilized to form the inner structure 150.

The inner structure 150 can be formed by a combination of stamping processes, folding processes, welding processes, hydro-forming processes, adhesive processes, and a variety of other construction processes and materials known to one of ordinary skill. It will be appreciated that in at least certain embodiments, the inner structure 150 is formed from a plurality of smaller components that are joined or connected to form the inner structure 150. It will be further appreciated that in at least some embodiments, one or more finishes or coatings can be applied to the inner structure, for example to provide increased resistance to extreme temperatures, to provide corrosion resistance, to facilitate cleaning of the fireplace oven 100, and/or to provide improved aesthetic appearance to the inner structure 150.

In some embodiments, the inner structure 150 comprises a plurality of rack supports 156 configured to support and locate one or more of the racks 120, 122, 124. The inner structure 150 also comprises one or more exhaust openings 160. The exhaust openings 160 are positioned and configured to facilitate withdrawal and venting of combustion components from combustion occurring within the combustion compartment 102. The particular size, shape, number, and arrangement of the exhaust openings 160 can be adjusted and formed according to the needs of a particular application by one of ordinary skill.

The inner structure 150 also comprises one or more air openings 162. The air openings 162 are arranged and configured to facilitate air draw of exterior air into the interior of the combustion compartment 102 to support combustion therein. In at least some embodiments, one or more air openings 162 can be configured and constructed in an adjustable manner such that the air flow through the respective air opening 162 can be regulated. This aspect of the fireplace oven 100 provides a throttling or damping feature to provide additional control of a combustion process occurring within the combustion chamber 102.

Figure 8:
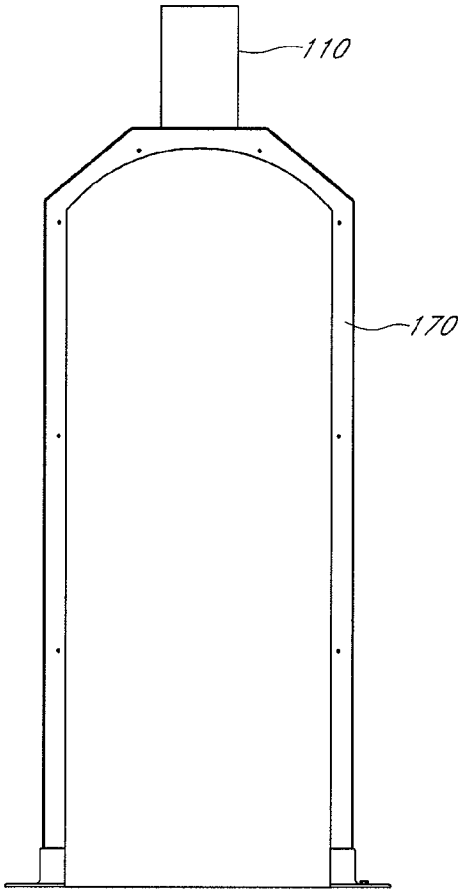
FIG. 8 is a front view of one embodiment of an intermediate structure of a fireplace oven.
Figure 7:
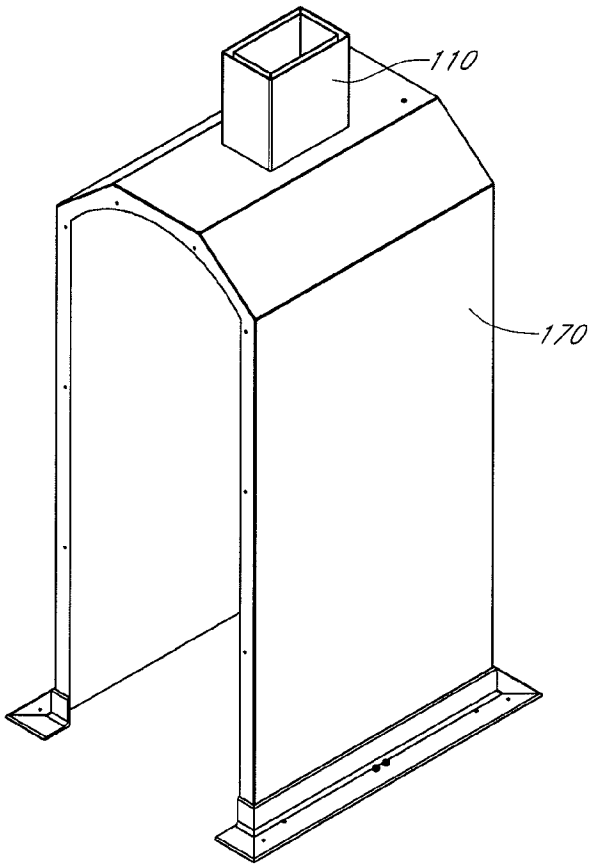
FIG. 7 is a front perspective view of one embodiment of an intermediate structure of a fireplace oven.

FIGS. 7 and 8 illustrate an embodiment of an intermediate structure 170 of a fireplace oven 100 in front perspective and front views, respectively. The intermediate structure 170 is formed and constructed to generally enclose and encompass the inner structure 150. While the intermediate structure 170 would similarly be expected to experience exposure to elevated temperatures and use, the intermediate structure 170 would generally be expected to experience lower temperatures than the inner structure 150. Nevertheless, the intermediate structure 170 is preferably constructed of relatively strong materials suitable for use at extreme temperatures. In a similar manner to the inner structure 150, suitable materials for the intermediate structure 170 can include cast iron and/or sheet metal.

Figure 9:
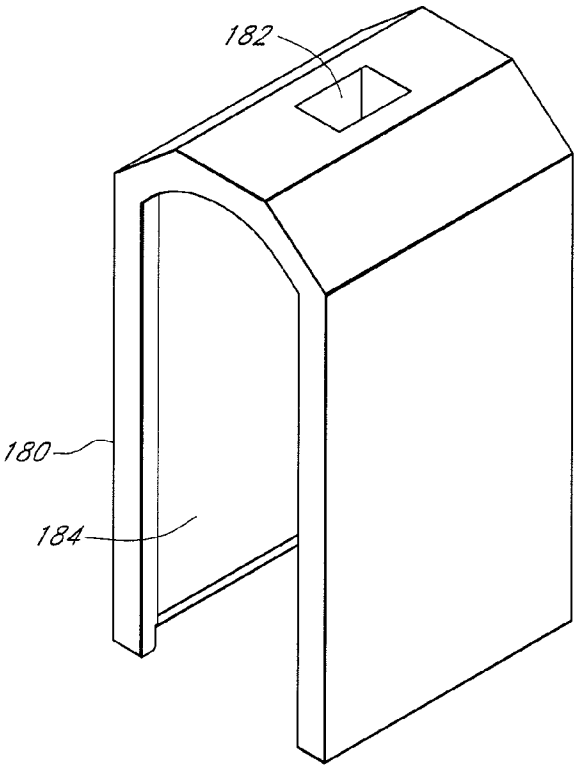
FIG. 9 is a front perspective view of one embodiment of an outer structure of a fireplace oven.

FIG. 9 is a front perspective illustration of an outer structure 180 of a fireplace oven 100. The outer structure 180 is sized and configured to substantially encompass and enclose the intermediate structure 170 and the inner structure 150. The outer structure 180 is also preferably formed of relatively high strength materials resistant to temperature extremes and can be suitably formed by materials such as cast iron, sheet metals, concrete, and/or plasters. The outer structure 180 comprises a chimney opening 182 configured to allow the chimney 110 to extend there through for venting of combustion components from the fireplace oven 100. The outer structure 180 also comprises a door opening 184 sized and configured to allow the combustion door 106 and oven door 108 to open and to provide clearance for placement and removal of items in the combustion compartment 102 and oven compartment 104.

Figure 10:
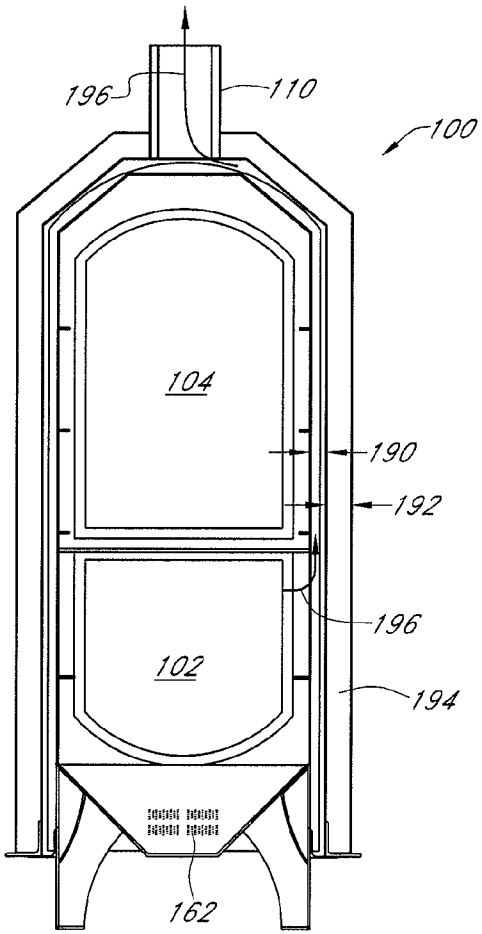
FIG. 10 is a front partial section view of one embodiment of an assembled fireplace oven.

FIG. 10 illustrates a partial front section view of an embodiment of an assembled fireplace oven 100 and further illustrating the relative locations and arrangements of the inner structure 150, the intermediate structure 170, and the outer structure 180. As can be seen in FIG. 10, the inner structure 150 is arranged at an inwardmost position, the intermediate structure 170 is arranged in an intermediate location, and the outer structure 180 is arranged at an outermost location. The interstitial space between the inner structure 150 and intermediate structure 170 defines an exhaust space 190. The exhaust space 190 is defined by the outer side, back, and upper surfaces of the inner structure 150 and inner side, back, and upper surfaces of the intermediate structure 170.

As previously noted, the inner structure 150 comprises one or more exhaust openings 160 to facilitate withdrawal and venting of material combustion components from combustion occurring within the combustion compartment 102. As the material combustion components are at an elevated temperature and the interior of the combustion compartment 102 is in fluid communication with the exhaust space 190 via the exhaust openings 160, naturally occurring convective forces will draw the material combustion components out the one or more exhaust openings 160, into the exhaust space 190, and upwards and out the chimney 110. The combustion products and direction of travel is indicated by the arrows and reference designator of 196 in FIG. 10.

An interstitial space also exists and is defined between the intermediate structure 170 and the outer structure 180. An outward space 192 occupies this interstitial region and is defined by the outer side, back, and upward surfaces of the intermediate structure 170 and inner side, back, and upper surfaces of the outer structure 180. The outward space 192 provides an isolation and insulation region between the elevated temperatures occurring during use of the fireplace oven 170 to be found at the intermediate structure 170. The outward space 192 provides an insulating separation such that intentional or incidental contact with the outer structure 180 provides reduced risk of burn injury in instances of such contact. In some embodiments, the outward space 192 may be partially or fully filled with insulation 194 to further improve the insulation and isolation properties of the outward space 192. In some embodiments, outer side, back, and/or upper surfaces of the outer structure 180 can be provided with additional insulating materials/coatings, such as plaster and/or heat resistant paint.

Thus, FIG. 10 illustrates a variety of advantageous features and aspects of the fireplace oven 100. The supports or legs 112 elevate a lower surface 114 of the fireplace oven 100 to provide an insulating separation between the lower surface 114 and materials and surfaces on which the portable fireplace oven 100 may rest. This provides increased safety and flexibility of placement of the fireplace oven 100 by avoiding undesirable heating of the surface upon which the fireplace oven rests which may otherwise cause damage or fire risks. Material combustion products 196 resulting from the combustion occurring within the combustion compartment 102 are vented out the one or more exhaust openings 160 and directed upwards and around the oven compartment 104 and out the chimney 110. As the oven compartment 104 is materially enclosed, contact of the material combustion products 116 with the interior of the oven compartment 104 is reduced. In some embodiments, less than 10% of the generated physical combustion products 196 are allowed to enter into the interior of the oven compartment 104. In other embodiments, the proportion of physical combustion products 196 that can enter into the interior of the oven compartment 104 is limited to no more than 5% and in further embodiments the proportion is limited to no more than 1%. As previously noted, limiting the amount of material combustion products 196 that are allowed to contact food items placed within the oven compartment 104 is desirable to avoid negatively affecting the taste, appearance, and cleanliness of the food being cooked.

However, the relatively hot combustion products 196 pass adjacent side, back, and upper surfaces of the inner structure 150 such that the heat generated by combustion occurring within the combustion compartment 102 can be preferentially conveyed to the oven compartment 104. As previously mentioned, preferred materials for construction of the inner structure 150 can include cast iron and/or sheet metals having a relatively high thermal conductivity such that the relatively high temperatures of the combustion products 196 can efficiently conduct heat through the inner structure 150 into the interior of the oven compartment 104. Further, the combustion/oven partition 136 is also in at least certain embodiments preferably formed of a material having relatively high thermal conductivity, such as metals, and can also efficiently conduct heat generated in the combustion compartment 102 to the adjacent oven compartment 104.

The outward space 192, which can be provided with insulation 194 in some embodiments, insulates the relatively high temperatures occurring during use found in the oven compartment 104, the combustion compartment 102, and the exhaust space 190 from the relatively lower temperatures found in the ambient environment. The arrangement of the outward space 192 provides the advantage of more efficiently maintaining heat within the oven compartment 104 both to improve the cooking conditions and reduce the amount of fuel needed to achieve a desired cooking temperature and time. The outward space 192 also provides increased safety by insulating the exterior of the fireplace oven 100 from elevated temperatures occurring in the interior of the fireplace oven 100 during use. As previously noted, the exterior of the outer structure 180 can be further provided with one or more insulative coatings to increase the insulative properties and/or to provide desired aesthetic appearances.

The fireplace oven 100 can be constructed using relatively inexpensive materials such as sheet steel, concrete and/or plaster. The fireplace oven 100 can be constructed using conventional well understood construction methods, such as stamping, hydro forming, welding, threaded fasteners, adhesives, and the like. The fireplace oven 100 can be provided in a variety of sizes and shapes to suit the requirements of particular applications.

Figure 11:
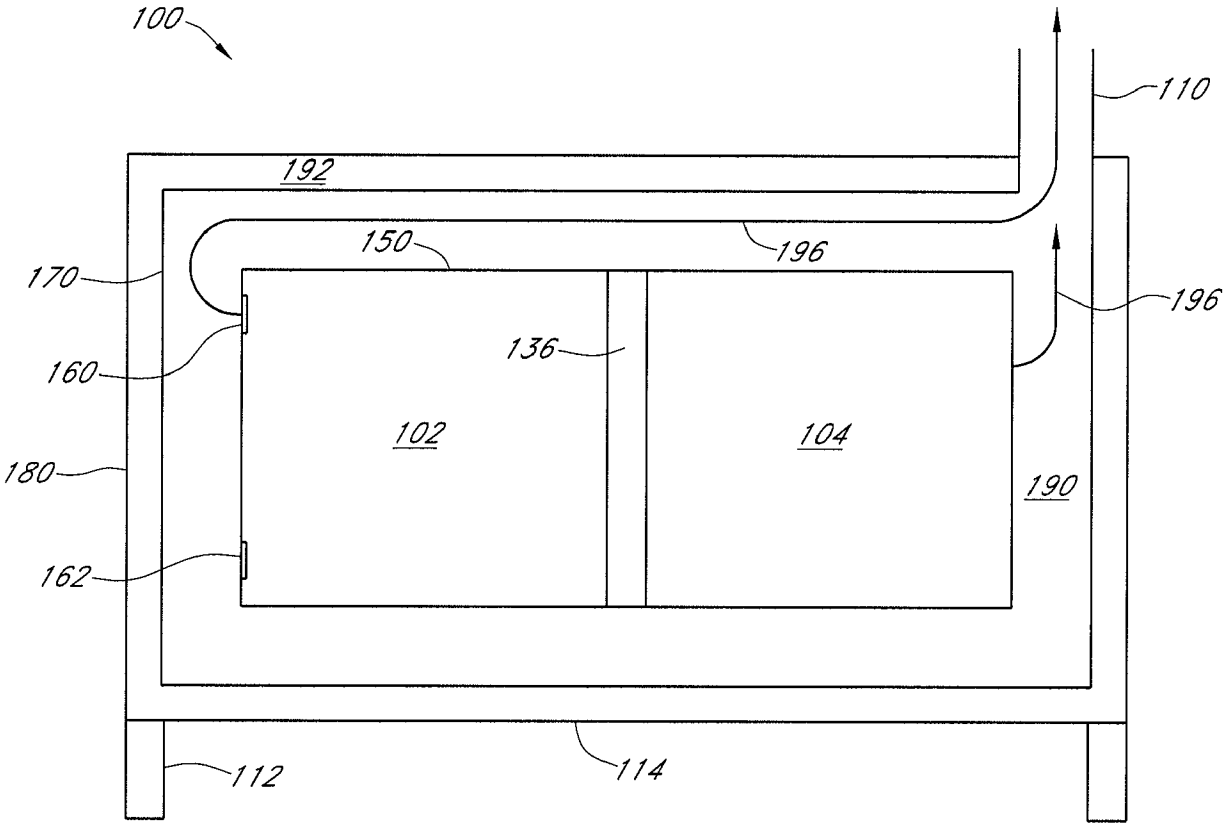
FIG. 11 is a side section view of another embodiment of fireplace oven.

While illustrated in FIGS. 1 through 10 in a generally vertically extending or stacked configuration, embodiments of the fireplace oven 100 can also be provided in a generally lay down or horizontally extending configuration as illustrated in FIG. 11. The embodiments illustrated in FIG. 11 comprise substantially similar components and construction methods as those embodiments of the fireplace oven 100 previously described and will not be repeated for brevity and ease of understanding.

The substantial difference between the embodiments illustrated and described with respect to FIGS. 1 through 10 and the embodiments illustrated by FIG. 11 are that the combustion compartment 102 and oven compartment 104 are arranged in a side-by-side relationship in the embodiments illustrated by FIG. 11 whereas the compartments 102 and 104 are arranged in a vertically stacked configuration in the embodiments illustrated in FIGS. 1 through 10. However, in the embodiments illustrated in FIG. 11, the material combustion components 196 would still be drawn by naturally occurring convective forces arising from the elevated temperatures of combustion past side, back, and outer surfaces of the oven compartment 104 facilitating increased deficiency of heat transfer from the combustion components 196 to the oven compartment 104. Similarly, the combustion/oven partition 136 is arranged and constructed to materially separate the oven compartment 104 from the combustion compartment 102 to reduce the exposure of food items placed in the oven compartment 104 with the material combustion products 196 while facilitating transfer of heat from the combustion compartment 102 through the combustion/oven partition 136 into the interior of the oven compartment 104.

Again, the fireplace oven 100 can be readily constructed in a desired size and configuration to suit the requirements of a particular application. Furthermore, while the illustrated and described embodiments comprise a combustion compartment 102 and an oven compartment 104, it will be understood that if indicated by the needs of a particular application, a plurality of combustion compartments 102 and/or oven compartments 104 can be provided without detracting from the scope of the invention.

What is claimed is:

1. A combustion appliance comprising:

an inwardly arranged structure defining combustion compartment and a separate oven compartment wherein the combustion compartment defines a cooking surface on which food is directly exposed to the combustion exhaust;

an outwardly arranged structure substantially encompassing the inwardly arranged structure;

an intermediate structure interposed between the inwardly and outwardly arranged structures;

an outward space interposed between the outwardly arranged structure and the intermediate structure and providing thermal insulation between the outwardly arranged structure and the inwardly arranged and intermediate structures;

an exhaust space arranged between the inwardly arranged structure and the intermediate structure and in fluid communication with the combustion compartment such that physical combustion components can vent from the combustion compartment through the exhaust space around at least a portion of the oven compartment and out from the appliance and such that the physical combustion components are materially separated from an interior of the oven compartment wherein the inwardly arranged structure comprises one or more exhaust openings providing fluid communication between the exhaust space and an interior of the combustion compartment; and a movable oven door such that actuation of the oven door can enclose or provide access to the interior of the oven compartment.

2. The combustion appliance of claim 1, wherein the oven compartment is arranged above the combustion compartment.

3. The combustion appliance of claim 1 further comprising insulation material arranged in at least a portion of the outward space.

4. The combustion appliance of claim 1, further comprising one or more air openings providing a path for fresh air to enter the combustion compartment.

5. The combustion appliance of claim 4, wherein the one or more air openings are adjustable to provide throttling for air entering the combustion compartment.

6. The combustion appliance of claim 1, further comprising a combustion/oven partition interposed between the combustion compartment and oven compartment and materially separating and providing a thermally conductive path between the combustion compartment and the oven compartment.

7. The combustion appliance of claim 1, wherein the appliance is portable and further comprising a plurality of legs such that a lower surface of the appliance is elevated above a surface upon which the legs rest.

8. The combustion appliance of claim 1, further comprising:

a fuel connector; and a combustion assembly in fluid communication with the fuel connector wherein the fuel connector and combustion assembly are configured to receive and combust at least one of liquid and gaseous fuels.

9. The combustion appliance of claim 1, further comprising a movable combustion door such that actuation of the combustion door can enclose or provide access to the interior of the combustion compartment for placement of solid fuels and removal of combustion remnants.

10. The combustion appliance of claim 9, wherein the combustion door is at least partially transparent such that at least a portion of the interior of the combustion compartment is visible from outside the appliance.

* * * * *